United States Patent [19]

Ueno

[11] Patent Number: 4,805,680

[45] Date of Patent: Feb. 21, 1989

[54] CARD CASE WITH A MAGNIFYING GLASS

[76] Inventor: Minoru Ueno, #403, 1-9, 3-chome, Nizigaoka Aso-ku, Kawasaki-shi, Kanagawa-ken, Japan

[21] Appl. No.: 897,027

[22] Filed: Aug. 15, 1986

[51] Int. Cl.[4] ..... A45C 11/18; G02B 27/02

[52] U.S. Cl. ..... 150/147; 150/145; 206/37; 206/39; 220/82 A; 350/243; 40/642

[58] Field of Search ..... 150/106, 147, 145, 148, 150/149; 206/39, 39.5, 38, 37; 350/243; 220/82 A; 40/10 R, 10 D, 158 B, 159, 625, 626; 243/76

[56] References Cited

U.S. PATENT DOCUMENTS

| | | | |
|---|---|---|---|
| 210,274 | 11/1878 | Stohlmann | 220/82 A X |
| 1,274,804 | 8/1918 | Spitzer | 40/158 B |
| 1,670,343 | 5/1928 | Clemens | 206/39.5 |
| 1,672,881 | 6/1928 | Douglass | 150/106 X |
| 3,117,608 | 1/1964 | Goss et al. | 206/39 X |
| 3,660,915 | 5/1972 | Davis | 40/10 R |
| 3,970,130 | 7/1976 | Casey | 150/149 |
| 4,435,912 | 3/1984 | Adrian et al. | 40/626 X |

FOREIGN PATENT DOCUMENTS

| | | | |
|---|---|---|---|
| 464383 | 4/1937 | United Kingdom | 150/106 |

*Primary Examiner*—Sue A. Weaver

*Attorney, Agent, or Firm*—Wenderoth, Lind & Ponack

[57] ABSTRACT

A card holder with magnifying glass includes at least one holding part in which cash cards, business cards or so on are put and which is enclosed with sheets. One of the sheets has a lens which is used in order to read small letters on the cards or others.

1 Claim, 2 Drawing Sheets

CARD CASE WITH A MAGNIFYING GLASS

BACKGROUND OF THE INVENTION

The present invention relates to a small portable case such as a purse type case, pass case or card case.

In the past, there have been a variety of this kind of case, which have been simple cases, cases with a plurality of layers and/or a fold-up type case. There is, however, no case with a magnifying glass.

BRIEF DESCRIPTION OF THE INVENTION

It is an object of the present invention to provide a card case with magnifying glass so that small letters, small numerals and/or small marks on cards and/or bankbooks pulled out from the card case or on other things can be read with the magnifying glass of the card case when they are out of the case.

The various novel features which characterize the present invention are pointed out with particularity in the claims annexed to and forming a part of this specification. For a better understanding of the invention, its operating advantage, and specific objects of its use, reference should be made to the accompanying drawings and descriptive matter in which there are illustrated and described a preferred embodiment of the invention. It should be understood that any change within the scope of the claims may be resorted to without departing from the spirit of the invention or sacrificing any of the advantages thereof.

DETAILED DESCRIPTION OF THE INVENTION

A preferred embodiment of the present invention will now be described.

Figure 1:
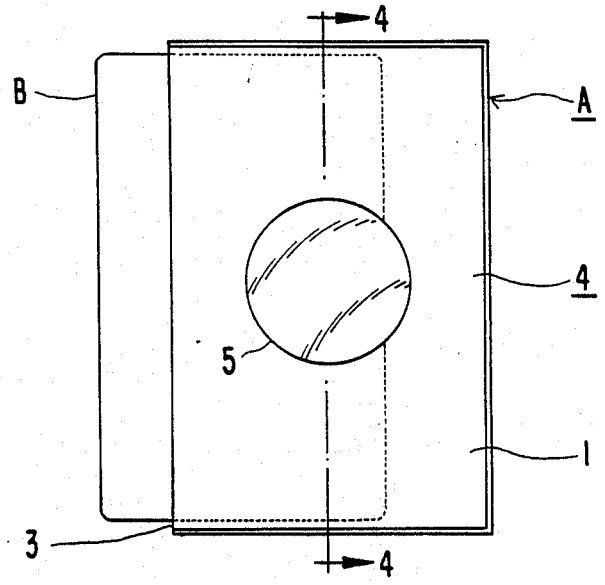
FIG. 1 is a front view of an embodiment of the card case of the present invention.
Figure 2:
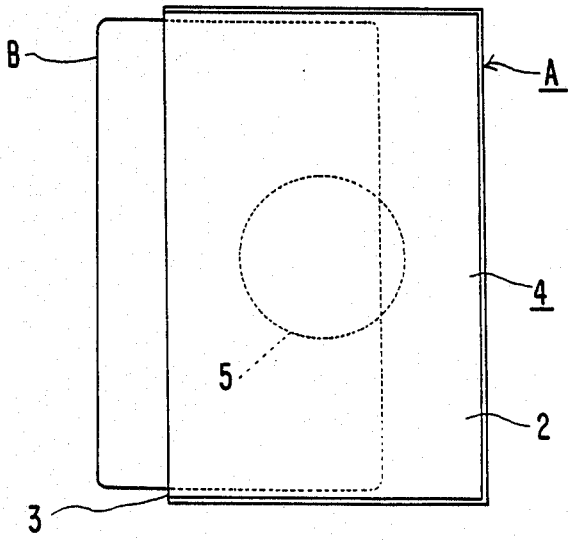
FIG. 2 is a back view of the card case of FIG. 1.
Figure 4:
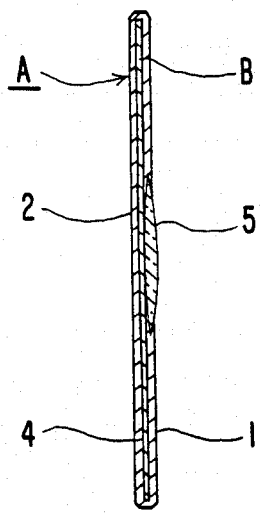
FIG. 4 is a central cross-sectional view taken on line 4—4 of the card case of FIG. 1.
Figure 5:
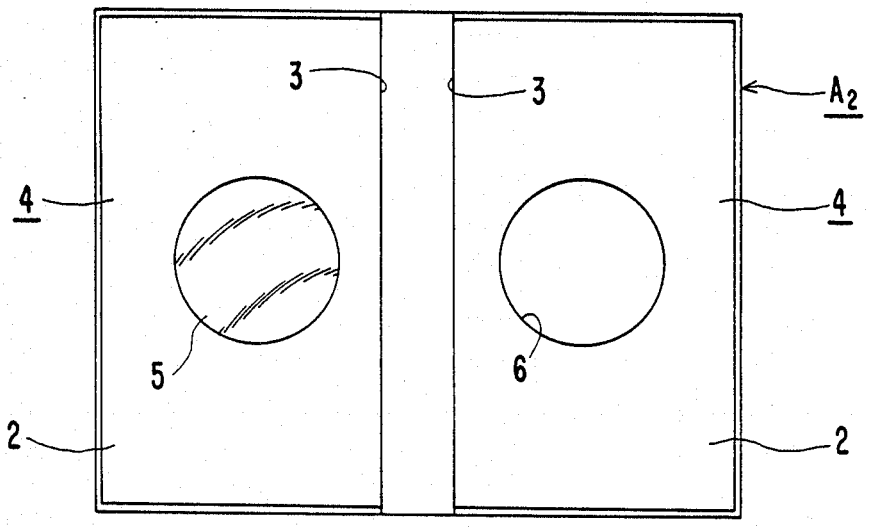
FIG. 5 is an enlarged front view of another embodiment of the card case of the present invention.

FIGS. 1 and 2 show a front and back view of a single case according to an embodiment of the present invention. FIG. 4 shows an enlarged front view of a fold-up type double case.

The present invention comprises a card case A with a magnifying glass, and which is composed of an outer sheet 1 and an inner sheet 2. Three edges of the inner sheet 2 are attached to the corresponding edges of the outer sheet 1 by adhesive, sewing or the like. The open part of the edges is used as an opening 3 for receiving or discharging a card B. Thus, a case A is made with the outer sheet 1 and the inner sheet 2 joined to form an envelope type holding case 4. A thin magnifying glass 5 is mounted in the outer sheet 1. Alternatively it can be mounted in the inner sheet 2. The magnifying glass 5 may be any one able to magnify a portrait or the like.

Figure 3:
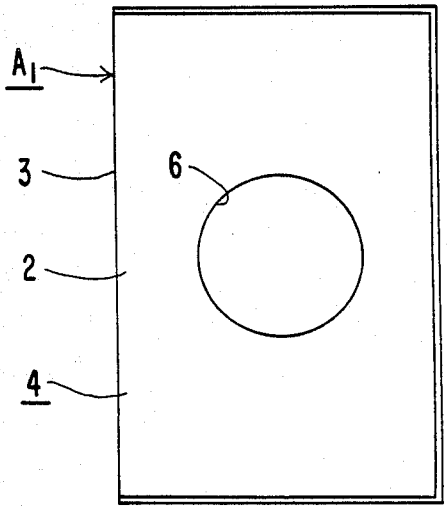
FIG. 3 is a back view of another embodiment of the card case of the present invention.

If the case A is made of transparent material, whether colored or not, the sheet other than the sheet with the magnifying glass 5, e.g. the inner sheet in FIG. 2, is not required to have a structure to help the function of the magnifying glass 5. However, the sheet other than the sheet having the magnifying glass may have a hole 6 about the same size as the magnifying glass 5 as shown in the case A, FIG. 3. While FIGS. 1 and 2 show a single case, FIG. 4 shows another embodiment of the present invention which is a fold-up type double case A2. In the fold-up type double case, it is preferable that the sheets other than those having the magnifying glass 5 have openings 6 as explained above.

The present invention is not limited to a card case with a magnifying glass limited by how said magnifying glass 5 is attached to said sheet 1 or 2, of what material said case A is made, or whether it is a single case or double case, etc., unless said magnifying glass has the function by which it magnifies patterns and is attached to one of said sheets 1 and 2. The present invention is not limited to a card case with magnifying glass having just one opening at said edges unless said card case has said holding case 4 which holds cards B.

Thus, as shown in FIG. 1, a card case with a magnifying glass 5 of the present invention can be used as a card holder for cards, bankbooks, business cards, and so on. The magnifying glass on the card case can be used as a lens which can magnify letters, numerals, marks on cards, etc., held in the card case A or on other cards, etc.

Said hole 6 in a sheet having no magnifying glass may be used not only for using said magnifying glass 5 to magnify items outside the case but also for pushing up a card in said holding case 4 with a finger so that the card therein can be pulled out.

I claim:

1. A card case comprising:

a plurality of sheets and means securing said sheets together to define a pocket for receiving card-shaped articles;

one of said sheets having, in a portion opposed to the other sheet on the opposite side of said pocket, a magnifying glass mounted in said sheet for enabling viewing of the contents of the pocket through said magnifying glass, the other of said sheets having an aperture therein opposite said magnifying glass and corresponding to the shape of the magnifying glass.

* * * * *